US005418701A

United States Patent [19]

Hart

[11] Patent Number: 5,418,701

[45] Date of Patent: May 23, 1995

[54] PORTABLE, LIGHT/POWER SOURCE AND GENERAL UTILITY APPARATUS

[76] Inventor: Don B. Hart, 1431 Via Plata, Long Beach, Calif. 90810-1462

[21] Appl. No.: 176,250

[22] Filed: Jan. 3, 1994

[51] Int. Cl.[6] ..... F21V 27/00; F21V 33/00

[52] U.S. Cl. ..... 362/376; 362/131; 362/154; 362/258; 362/270; 362/287; 362/295; 362/387; 362/419; 362/431

[58] Field of Search ..... 362/131, 132, 154, 270, 362/287, 387, 376, 399, 295, 419, 431, 258

[56] References Cited

U.S. PATENT DOCUMENTS

| | | | |
|---|---|---|---|
| 4,232,357 | 11/1980 | Dietz | 362/431 |
| 4,298,907 | 11/1981 | Holt, Jr. | 362/419 |
| 5,195,823 | 3/1993 | Sidabras | 362/387 |
| 5,307,255 | 4/1994 | Chen | 362/431 |

*Primary Examiner*—Ira S. Lazarus
*Assistant Examiner*—L. Heyman
*Attorney, Agent, or Firm*—Albert O. Cota

[57] ABSTRACT

An apparatus (10) that combines within a unitary protective tubular structure (12) a retractable, extendable and omni-positionable light assembly (20) that houses a halogen lamp (20I that is controlled by a switch/circuit breaker (22A). The switch is attached to the housing and is connected in series between the lamp (20I) and a lamp power cord (22B,22E) that terminates at the output of a utility-power junction box (32) that includes a pair of auxiliary a-c power outlets (32L). The input to the junction box (32) is a primary power input cord that terminates with a male power input connector (32J). The connector (32J) connects with a female connector (36A) that is attached to one end of an electrical power cord (36) and that is fixedly attached to a power-cord reel (38). The other end of the cord (36) is wound around the power-cord reel (38) and terminates with a male connector (36B) that connects to an a-c power outlet. When the switch/circuit breaker (22A) is placed in the ON position, the lamp (20I) illuminates. The apparatus also features an enclosed, lockable compartment (42) suitable for storing tools, a set of detachable wheel assemblies (44) and a sitting and storage assembly (46).

21 Claims, 5 Drawing Sheets

PORTABLE, LIGHT/POWER SOURCE AND GENERAL UTILITY APPARATUS

TECHNICAL FIELD

The invention pertains to portable, general utility work stations/apparatuses and more particularly to an apparatus that includes a protective structure having attached a light assembly that is articulated by a universal joint mounted to a telescoping structure, a power cord reel, an enclosed tool compartment and a sitting and storage assembly.

BACKGROUND ART

The utility inherent in portable work apparatuses and particularly those that include light assemblies that are powered by an extendable a-c power cord, is well established. These apparatuses are typically used in automotive repair shops, construction and excavation sides and also find utility for home use.

The field of portable work apparatuses is replete with designs that include various types of articulated, a-c powered light assemblies and means for storing and extracting the lamp power cord to a source of a-c utility power. In general, the prior aft devices have a base frame to which is swivelly attached the light assembly. In most designs, a light assembly housing is mounted to a structural member on the base frame that allows the light to be adjusted within the confines of single-plane arcs. The base frame can also include on its lower surface, a set of skids or a set of permanently mounted wheel assemblies.

The biggest problem inherent in current portable light assembly designs is their fragility. Because these assemblies are typically used in less than ideal environments, they are often subject to being dropped, pushed and/or kicked. To protect the assembly from these adverse occurrences, the light assembly in some designs, is encased in a heavy protective structure that increases the weight which then poses moving and lifting problems.

A search of the prior art did not disclose any portable light assembly that included a unitary protective tubular structure that contains, with the exception of a set of detachable wheel assembly and a sitting and storage assembly, all the elements that comprise the invention. These elements include a light assembly that is attached to a combination rotatable sleeve and multisectional-telescoping structure, that allows the lamp to be retracted and stowed within the housing or to be extended to a selectable height and then rotated in any omnidirectional position. Additionally, the combination of the detachable wheel assemblies, the enclosed compartment, the sitting and storage assembly and the design of the power-cord reel were not disclosed. Thus, no patents were found that read directly on the claims of the instant invention. However, the following U.S. patents were considered related:

| U.S. PAT. NO. | INVENTOR | ISSUED |
|---|---|---|
| 5,195,823 | Sidabras | 23 March 1993 |
| 5,126,928 | Hughes | 30 June 1992 |
| 5,003,450 | Burton, et al | 26 March 1991 |

The Sidabras U.S. Pat. No. 5,195,823 discloses a lamp and extension cord set consisting of a removable extension cord reel and lamp set mounted onto a stable base frame platform and provided with two handlebars for carrying. The extension cord reel connects a lamp to an external power supply and is provided with a curved stop bar as a safety feature and a handlebar for carrying the reel. The lamp set contains the light source within a lamp head and a lamp cover. A power switch and a separate retractable power cord are attached to the lamp set for connection to the external power supply with or without the extension cord reel. The lamp may be pivoted or rotated both horizontally and vertically with respect to the base frame, to adjust the direction of the light beam from the lamp. The lamp assembly may also be removed from the base frame, to provide an overhead light source if desired.

The Hughes U.S. Pat. No. 5,426,928 discloses a mobile boom-mounted light. The light is particularly adapted to use in connection with the maintenance and repair of all types of motor vehicles. The light provides for four separate degrees of freedom in positioning the light fixture by employing an articulated boom arrangement. Also included in the light design is a mobile base, a vertical stand and a boom assembly that further includes an arm, a light fixture and a counter weight. The boom arrangement allows the light fixture to rotated transversely about the upright longitudinal axis of the stand, to be rotated vertically, to be rotated about the axis of the boom arrangement and to be pivoted from its position on the end of the boom. The position of the light and boom are fixed by a brake and friction plate mechanism.

The Burton U.S. Pat. No. 5,003,350 discloses a portable light fixture which is specifically adapted to be hand-held and utilized for emergency applications, particularly with respect to motor vehicles. The fixture consists of a conical-shaped lens which is rotatably mounted to a cylindrical housing. Disposed within the interior of the housing is a spool which is rigidly attached on one end of the lens and on the other end to a plate. The plate is located on the bottom of the housing, such that the lens, spool and bottom plate will rotate in unison. The spool further includes a wound electrical cord one end of which is connected to a conventional light bulb disposed beneath the lens. The opposite end of the cord includes a connector which may be inserted into a cigarette lighter of an automobile, or alternatively connected by way of alligator clips to the battery terminals of the automobile.

For background purposes and as indicative of the art to which the invention is related, reference may be made to the following remaining patents found in the search.

| U.S. PAT. NO. | INVENTOR | ISSUED |
|---|---|---|
| 4,535,391 | Meng-Chang | 13 August 1985 |
| 4,075,470 | Moore | 21 February 1978 |

Taiwan application 82211335 filed 7 Aug. 1993.

DISCLOSURE OF THE INVENTION

A portable light/power source and general utility apparatus that is designed to be used indoors as well as outdoors. The apparatus is further designed to be used by professional tradepersons such as automobile and aircraft mechanics, on-site construction workers as well as "do it yourself" house craftsman. In its most basic design, the apparatus consists of:

1. a protective tubular structure that includes a left tubular section, a right tubular section and a plurality of transverse members attached to the upper and lower longitudinal members of the left and right tubular sections.
2. a light assembly having a halogen lamp that is enclosed within a lamp housing. The housing includes a lamp-power junction box that incorporates a switch/circuit breaker connected in series between a first side of a lockable power input connector and a first terminal of the lamp. The second lamp terminal is connected to a second side of the lockable power input connector.
3. an articulated light assembly attachment mechanism that includes a rotatable sleeve, a universal joint and a multisectional-telescoping structure. The rotatable sleeve is inserted into a front, upper transverse member of the protective tubular housing. The universal joint has an upper section and a lower section, where the upper section is attached to the lower side of the lamp housing. The multisectional-telescoping structure has an upper section attached to the lower section of the universal joint, and a lower section attached to the rotatable sleeve. The combination of the rotatable sleeve, the universal joint and the telescoping structure allow the light assembly to be extended to a preferred height and placed in selectable omnidirectional positions, or be retracted for safe stowage within the protective tubular structure.
4. an attachment plate attached within the protective tubular structure. The inward side of the plate has attached a reel axle and to its outward side is attached a utility-power junction box. The box has attached to one side the lockable power-input connector from the light assembly and on the other side extends a primary power input cord that terminates with a male power connector.
5. a power-cord reel that is captively inserted into the reel axle. The reel has an inward retainer to which is attached a female connector of an electrical power cord. The cord which is wound around the reel, terminates with a male connector that plugs into an a-c utility power outlet. When the female connector of the electrical power cord is connected to the male power connector of the primary-power input cord and the switch/circuit breaker is placed in the ON position, power is applied to the light assembly lamp,
6. an enclosed compartment attached to and within the protective tubular structure. The compartment includes a hinged, lockable front door,
7. a detachable wheel assembly attached to each lower corner of the lower longitudinal members of the left and right tubular sections, and
8. a sitting and storage assembly that includes a basin-like container having a lower surface that attaches to the upper longitudinal members of the left and right tubular sections. To the top of the basin is hingedly attached a resilient pad that functions as a basin cover and as a sitting pad.

In view of the above disclosure, it is the primary object of the invention to include in one apparatus several implements that aid craft and tradepersons to facilitate their various work assignments.

In addition to the above primary object, it is also an object of the invention to produce an apparatus that:

includes a light assembly that is attached to an articulated light-assembly attachment mechanism consisting of a universal joint, a telescoping structure and a rotatable sleeve. The mechanism allows the light assembly to be retracted and extended to various heights, where it can be placed in various angular positions, is housed within a protective housing that protects the light assembly and the other enclosed implements from all sides, allows an extension cord to be conveniently stored when not in use, allows the apparatus to be placed on a set of detachable wheel assemblies, includes a sitting and storage assembly that allows a person to sit or lay on his/her back while performing a work assignment and to store tools and the like, includes an enclosed compartment into which may be placed tools and other work implements, is reliable and relatively maintenance free, and is cost effective from both a manufacturers and consumer's point of view.

BEST MODE FOR CARRYING OUT THE INVENTION

Figure 1:
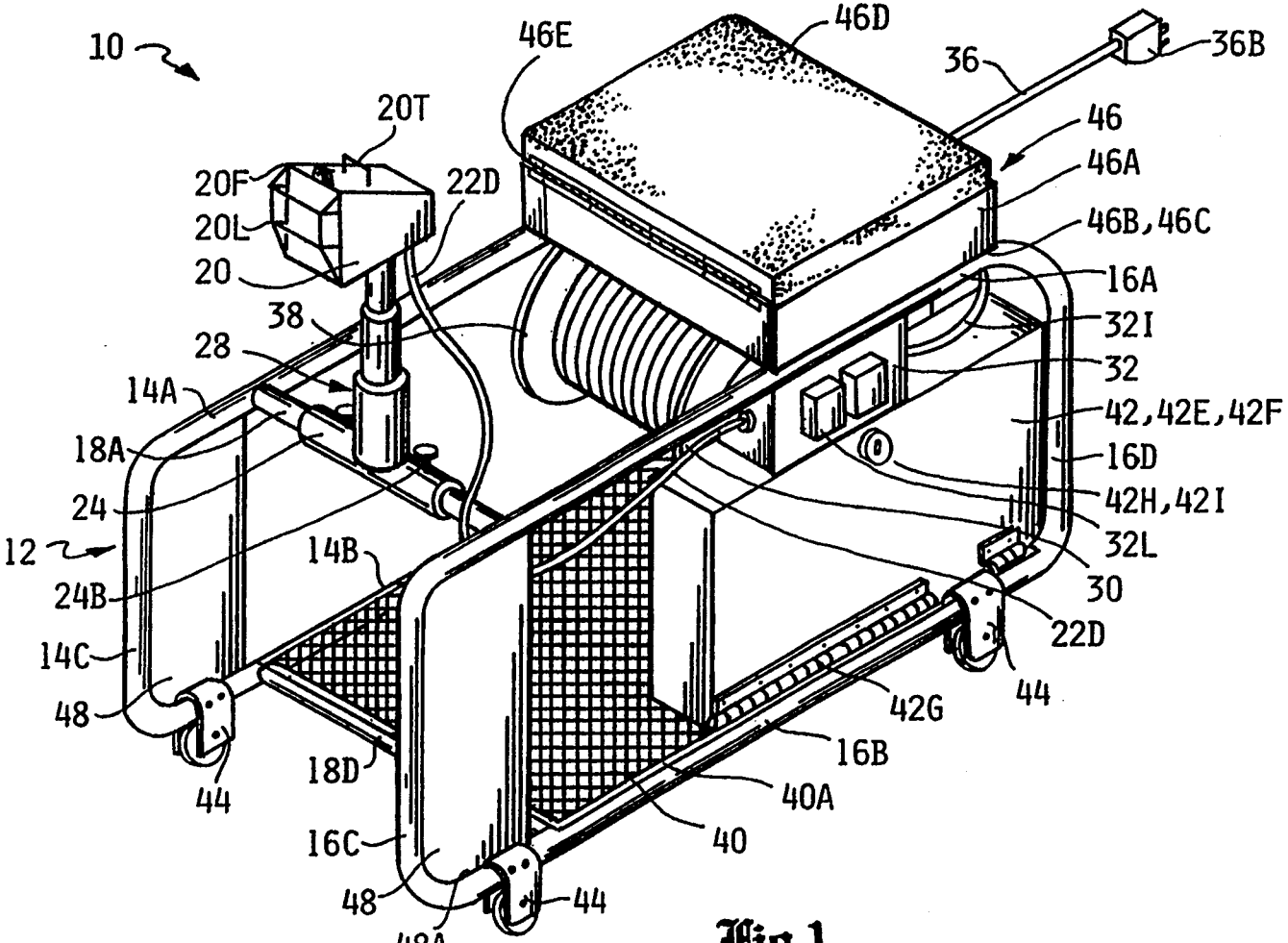
FIG. 1 is a perspective view of the portable, light/-power source and general utility apparatus.

The best mode for carrying out the invention is presented in terms of a preferred embodiment that is designed to provide a convenient and easy to use portable light/power source and general utility apparatus 10. The apparatus 10 as shown in FIGS. 1–11 is comprised of fourteen major elements: a protective tubular structure 12, a light assembly 20, an electrical lamp-power circuit 22, an articulated light assembly attachment mechanism 23 consisting of a rotatable sleeve 24, a universal joint 26, a multisectional-telescoping structure 28, an attachment plate 30, a utility power junction box 32, a power cord reel 38, a grated platform 40, an enclosed compartment 42, a detachable wheel assembly 44 and a sitting and storage assembly 46.

Figure 2:
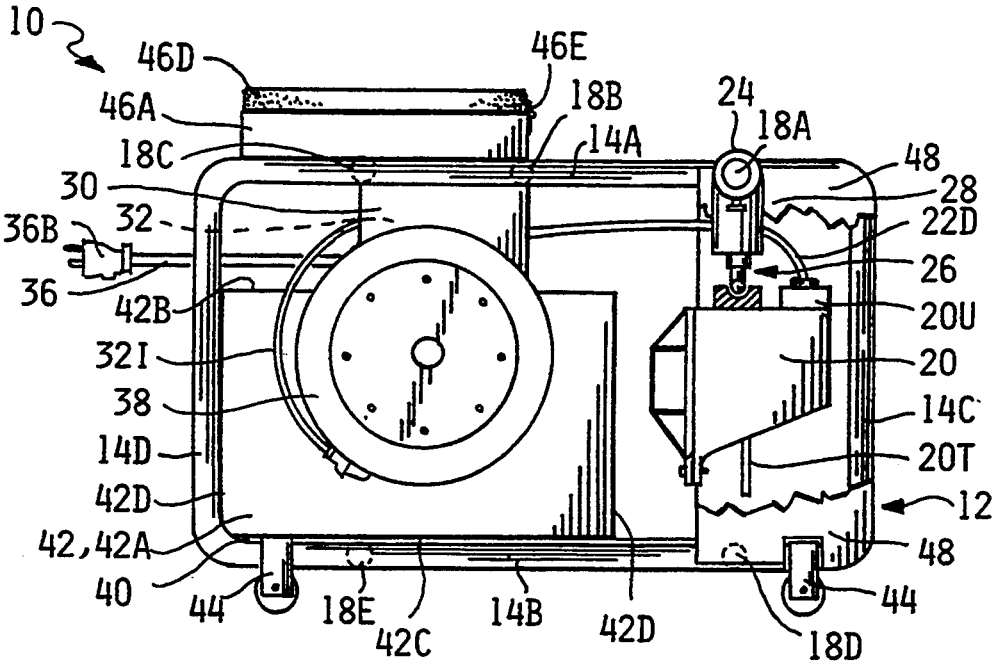
FIG. 2 is an elevational, left side view of the apparatus showing the light assembly in the retracted position.
Figure 3:
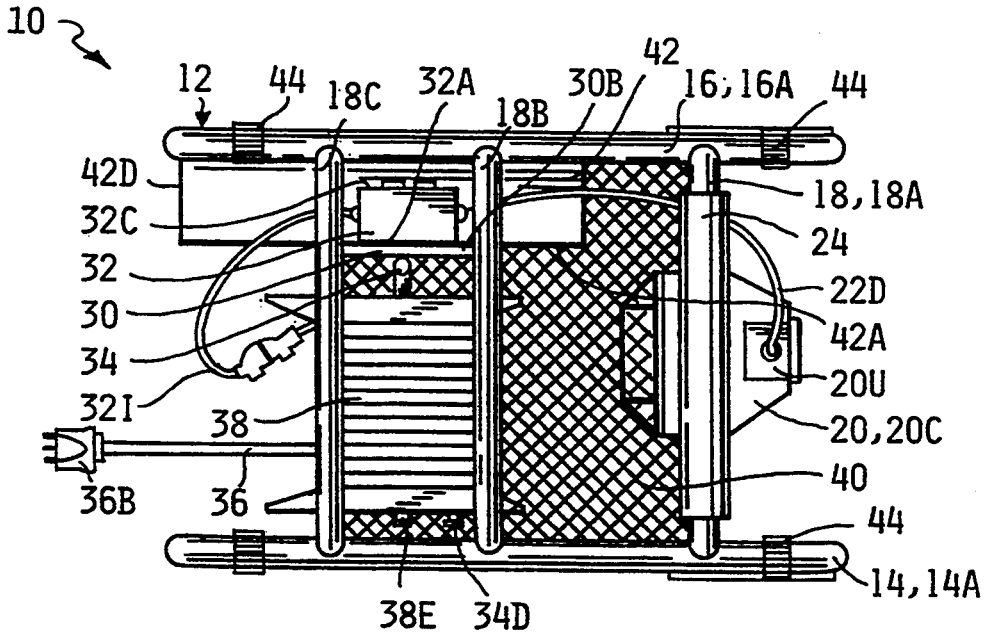
FIG. 3 is a top plan view of the apparatus.

The protective tubular structure 12 is the primary structural member of the apparatus 10. The structure 12 as shown in FIGS. 1–3, comprises a left tubular section 14, and a right tubular section 16. The section 14 contiguously has an upper longitudinal member 14A, a lower longitudinal member 14B, a front member 14C and a back member 14D. The member 16 likewise has an upper longitudinal member 16A, a lower longitudinal member 16B, a front member 16C and a back member 16D. Across the upper longitudinal members 14A,16A, are attached a set of transverse members 18 that include a front, upper transverse member 18A, a center, upper transverse member 18B and a rear upper transverse member 18C. Across the lower longitudinal members 14B,16B is attached a front, lower transverse member 18D and a back, lower transverse member 18E. The horizontal members are preferably attached by either a welding or brazing process.

Figure 4:
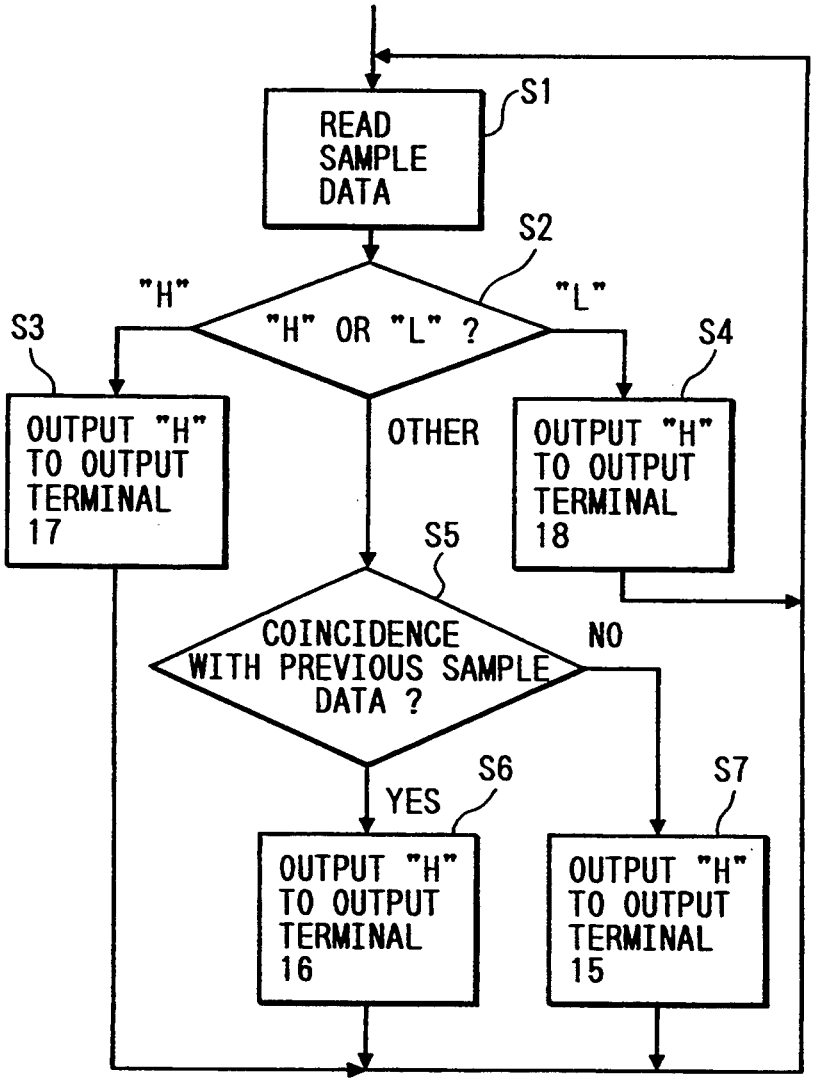
FIG. 4 is an elevational side view showing the light assembly mounted to an extended multisectional-telescoping structure that is attached to a rotatable sleeve. This figure also shows the lamp power cord attached to a utility-power junction box itself attached to an attachment plate.
Figure 5:
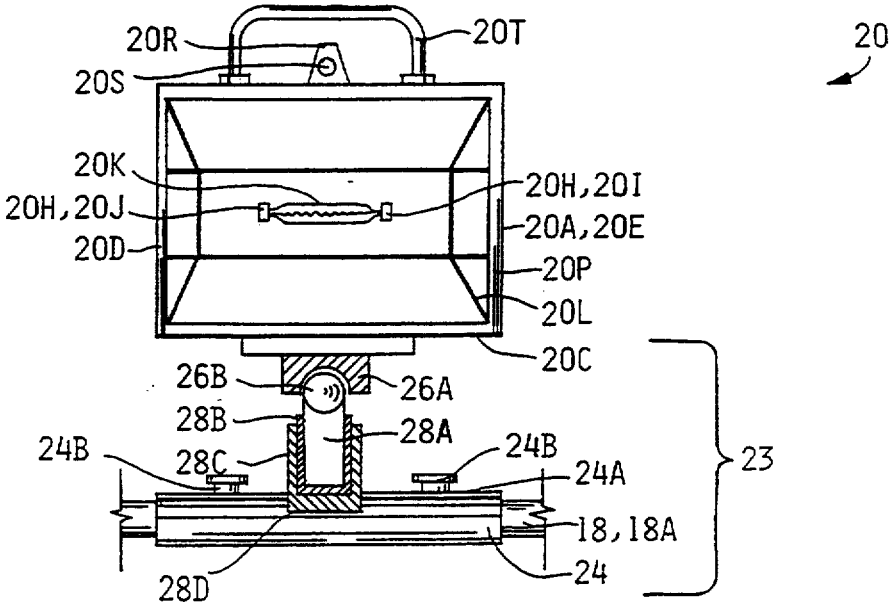
FIG. 5 is a front elevational front view of the lamp assembly attached to a retracted multisectional-telescoping structure.

The light assembly 20 is shown in its extended position in FIGS. 1 and 4, in its retracted and rotated position in FIG. 2 and in its retracted position in FIG. 5. The light assembly 20 includes a lamp housing 20A having an upper side 20B, a lower side 20C, a left side 20D, a right side 20E, a front side 20F and a back side 20G. Within the housing 20A is located a lamp socket 20H that has a first side 20I and a second side 20J. Into the socket is inserted a lamp 20K that preferably consists of a halogen lamp. To the housing's front side 20F is attached, by an attachment means, a protective lamp guard 20L that protects the lamp 20K from inadvertent contacts. In the preferred embodiment, the lamp guard attachment means, as shown in FIGS. 4 and 5, consists of a lamp housing 20A that includes on its upper side, an upward extending threaded tab 20M and on its lower side 20C, an inward lip 20N. The lamp guard 20L includes a guard frame 20P which captively retains the guard 20L. The bottom of this frame has a U-shaped bottom end 20Q, that is sized to be hooked to the inward lip 20N on the housing. The upper side of the guard frame 20P has an upward tab 20R having a bore therethrough that is aligned with the threaded tab 20M. Into the two tabs is inserted a threaded bolt 20S. When so threaded, the frame 20P is detachably held against the housing 20A.

The lamp housing 20A also has attached to its upper side, by an attachment means, a handle 20T. The handle is used for lifting the housing 20A from its retracted position and is especially useful when retracting a housing when the housing is hot from the lamp being illuminated.

Figure 6:
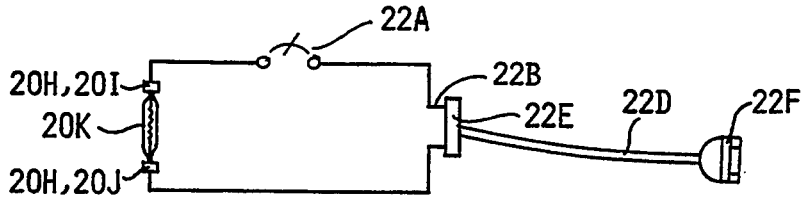
FIG. 6 is a schematic diagram of the electrical lamp-power circuit of the lamp-power junction box.
Figure 7:
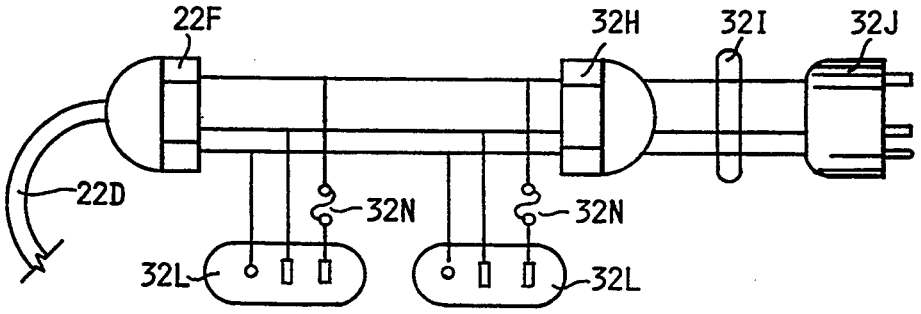
FIG. 7 is a schematic diagram of the utility-power junction box.

The final component that comprises the light assembly 20, is a water-proof, lamp-power junction box 20U as shown in FIG. 4, that is attached to the lower side 20C of the housing 20A by an attachment means. The box encloses an electrical lamp-power circuit 22 as shown in FIG. 6. The circuit 22 consists of a combination switch/circuit breaker 22A that is connected between a first side 22B of a lamp power cord 22D and to the first side 20I of the lamp socket 20H. The second side 20J of the lamp socket 20H is connected to the second side 22C of the lamp power cord 22D. Both sides of the lamp power cord terminate at a water-proof grommet 22E that attaches to the bottom side 22V of the lamp-power junction box 20U. From the grommet, extends the lamp power cord 22D that terminates at a lockable, power output connector 22F. To maintain the water-proofing of the junction box, the switch/circuit breaker has a water-proof jacket 22G placed over its switch lever which projects through the front of the lamp-power junction box 20U.

One of the innovative elements of the invention is the articulated light-assembly attachment mechanism 23. This assembly as shown best in FIGS. 4 and 5, consists of three components, a rotatable sleeve 24, a universal joint 26 and a multisectional-telescoping structure 28. The rotatable sleeve 24 is sized to be rotatably inserted into the front, upper transverse member 18A. Near either edge, or near both edges of the sleeve, is located a threaded lock bore 24A. Into these bores is threadably inserted a capped locking bolt 24B that maintains the sleeve 24 at selectable rotatable positions. To facilitate the rotational movement of the sleeve 24, it may include an inner Teflon$^{(R)}$ or Nylon$^{(R)}$ inner sleeve. The rotatable positions include an upward working portion as shown in FIGS. 1 and 4 and a downward, stowed position as shown in FIG. 2. In the stowed position, the light assembly 20 is protectively located within the confines of the protective tubular structure 12.

The universal joint 26 as shown in FIGS. 4 and 5, includes a hemispherical upper section 26A and a lower section 26B. The upper section is attached by an attachment means 26C, to the lower side 20C of the housing 20A of the light assembly 20. Preferably, the lower side 20C includes a metal reinforcing plate to provide additional structural integrity to the attachment means 26C.

The preferred attachment means for the universal joint 26 consists of having a light assembly housing that has a lower side with at least two housing bores 20W therethrough; and a mounting plate 20X having a lower surface to which is attached the hemispherical upper section 26A of the universal joint. The plate 20X has at least two attachment bores 20Y therethrough that are in alignment with the corresponding set of housing bores 20W. Into the two bores is inserted a threaded bolt 20Z that holds the mounting plate to the housing. The ball-shaped lower section 26B of the universal joint is attached to the upper surface of the upper section 28A of the multisectional telescoping structure 28. The ball 26B is sized to rotatably traverse within the hemispherical upper member 26A.

The third and final component of the articulated light assembly attachment mechanism 23 is the multisectional-telescoping structure 28 as shown extended in FIG. 4 and retracted in FIG. 5. The structure 28 in a preferred embodiment, consists of three sections: an upper section 28A, a center section 28B and a lower section 28C. The upper section 28A is rigidly attached by an attachment means 28D, to the lower section 26B of the universal joint 26. The lower section 28C is likewise rigidly attached by an attachment means 28D, that preferably consists of welding or brazing, to the surface of the rotatable sleeve 24. The combination of the rotatable sleeve 24, the universal joint 26 and the multisectional telescoping structure 28 allows the light assembly 20 to be extended to a preferred height and placed in selectable omnidirectional positions, or to be retracted for stowage within said protective tubular structure 12.

Figure 8:
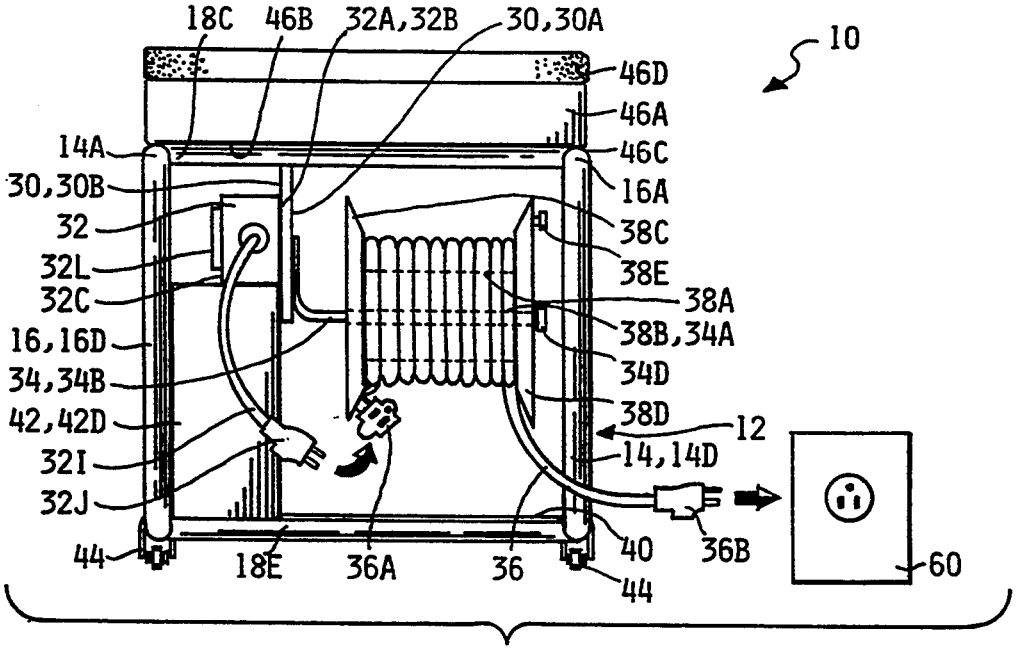
FIG. 8 is an elevational back view of the apparatus.

The attachment plate 30 as shown best in FIGS. 4 and 8, has an inward side 30A, an outward side 30B and an upward edge 30C. The upward edge 30C is located inward from the inside edges of the right tubular section 16 of the protective tubular structure 12 as shown in FIG. 8. The plate is attached to the lower surface of the center, upper transverse member 18B, and the rear, upper transverse member 18C of the protective tubular structure 12. The attachment plate is used to attach the utility-power junction box 32 and the reel axle 34.

The utility-power junction box as shown in FIGS. 1, 3, 4 and 7, has an inward side 32A, an outward side 32C, a first side 32D and a second side 32F. The inward side 32A is rigidly attached, by an attachment means 32B, to the outward side 30B of the attachment plate 30 as shown best in FIG. 3. The first aide 32D as shown best in FIG. 4, has a first bore 32E that receives and has attached the lockable, power output connector 22F of the lamp-power cord 22D. The second side 32F has a second bore 32G that receives and has attached a lockable, power input connector 32H. The connector 32H is attached to a primary power input cord 32I that terminates at a male power input connector 32J that connects to a female connector 36A as described infra. The power junction box 32 includes in its electrical power-input circuit as shown schematically in FIG. 7, at least one and preferably two auxiliary a-c power circuits where each circuit, is protected by a circuit breaker or a fuse 32N. Each circuit terminates at an auxiliary a-c power-output socket 32L that include moisture proof doors. As shown in FIG. 4, two such sockets extend from the outward side 32C of the power junction box to allow an external power implement such as a power tool to be electrically connected and operated. The reel axle 34 as best shown in FIG. 8, has a threaded front end 34A that extends outward within the confines of the left tubular structure 12 and a back end 34S. The back end is rigidly attached, by an attachment means, to the inward side 30A of the attachment plate 30. The reel axle used to rotatably retain the power-cord reel 38 as shown in FIGS. 3 and 8. The reel consists of a center core 38A having therethrough, a reel bore 38B, and on one end of the core, an inward retainer 38C and on the other end an outward retainer 38D. The reel bore 38B is sized to rotatably fit into the reel axle 34. To the edge of the inward retainer is rigidly attached the female connector 36A of an electrical power cord 36 with the remainder of the cord 36 wound around the center core 38A of power cord reel 38. The other end of the cord has a male connector 36B that plugs into an a-c utility power outlet 60. The outward side of the outward retainer 38D further has a rotatable knob 38E that allows an individual to turn the power-cord reel to retract the electrical power cord 36 onto the reel when the power cord is not being used. When the power cord 36 is connected to the utility power outlet 60, and the male connector 32J is connected to the female connector 36A and the combination switch/circuit breaker 22A is set to the ON position, the lamp 20K in the light assembly 20 will illuminate.

The reel axle 34 also includes a threaded reel-axle cap 34D. When this cap is threaded into the threaded front end 34A of the reel axle 34, the power cord reel 38 remains captive. Conversely, when the cap is removed, the power cord reel 38 may be removed from the apparatus for maintenance or for a use external to the apparatus 10.

To increase the utility of the apparatus 10, it also includes a grated platform 40 as shown in FIGS. 1 and 3. The platform has reinforced edges 40A and is sized to be attached by an attachment means, such as welding, to the upper surface of the left and right lower longitudinal members 14B,16B and the front and back lower transverse members 18D,18E.

The apparatus 10 also includes an enclosed compartment 42 as shown in FIGS. 1, 2 and 3 that consists of a back side 42A, a top side 42B, a bottom side 42C, two ends 42D and a frontal opening 42E. The outer surface of the back side 42A is attached, by an attachment means, to the lower, outward side of the attachment plate 30, below the utility-power junction box 32. The bottom side 42C is attached, by an attachment means to the upper surface of the lower longitudinal member 16B of the right tubular section 26 and the back, lower transverse member 18E.

To secure the enclosed compartment 42, a front door 42F is utilized that has one of its longitudinal edges swivelly attached to one of the longitudinal edges of the frontal opening 42E by a hinge 42G. The front door 42F preferably has a lock bore 42H therethrough located neap the edge opposite the hinge 42G. Into the lock bore is inserted and attached a locking device 42I that secures the front door 42F.

Figure 9:
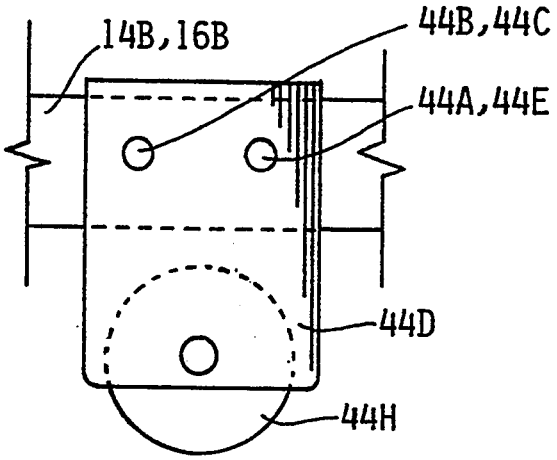
FIG. 9 is an elevational side view of a preferred design of the detachable wheel assembly.
Figure 10:
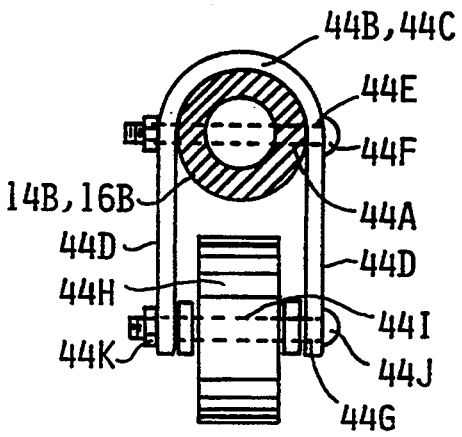
FIG. 10 is an elevational front view of the preferred detachable wheel assembly.

To facilitate moving the apparatus from one location to another, a detachable wheel assembly 44 is utilized as shown best in FIGS. 1, 9 and 10. To make the wheel attachment, the lower longitudinal members 14B,16B of the left and right tubular sections 14,16 each have therethrough, near their corners, a horizontal housing attachment bore 44A. The assembly 44 includes a U-shaped wheel housing that has a curved upper section 44C sized to frictionally fit over the top of the lower longitudinal members 14B,16B. Each of the sections 44C also have downward sections 44D that extend substantially below the lower plane of the lower longitudinal members. At least one housing bore 44E is located central to the diameter of the lower longitudinal member and a wheel-axle bore 44G is located through both of the downward sections 44D near their lower edges.

To attach the U-shaped wheel housing, at least one housing attachment bolt and nut combination 44F is inserted and attached through the housing bores 44E and the housing attachment hope 44A. A wheel 44H having an axle bore 44I is rotatably housed between the inside surfaces of the U-shaped wheel housing 44B. To retain the wheel 44H, an axle 44J is inserted through the wheel axle bores 44G on the housing and the axle bore 44I. The axle 44J includes means for allowing the wheels to be maintained in place.

Figure 11:
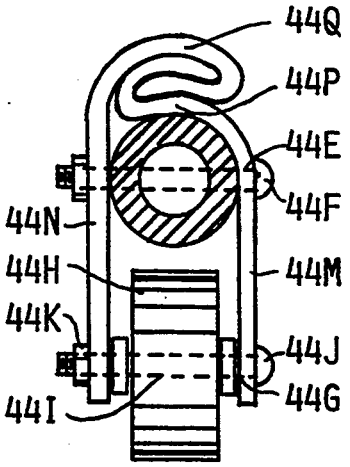
FIG. 11 is an elevational front view of a second design for a detachable wheel assembly. This second design allows the assembly to be removed while the wheels remain attached.
Figure 4:
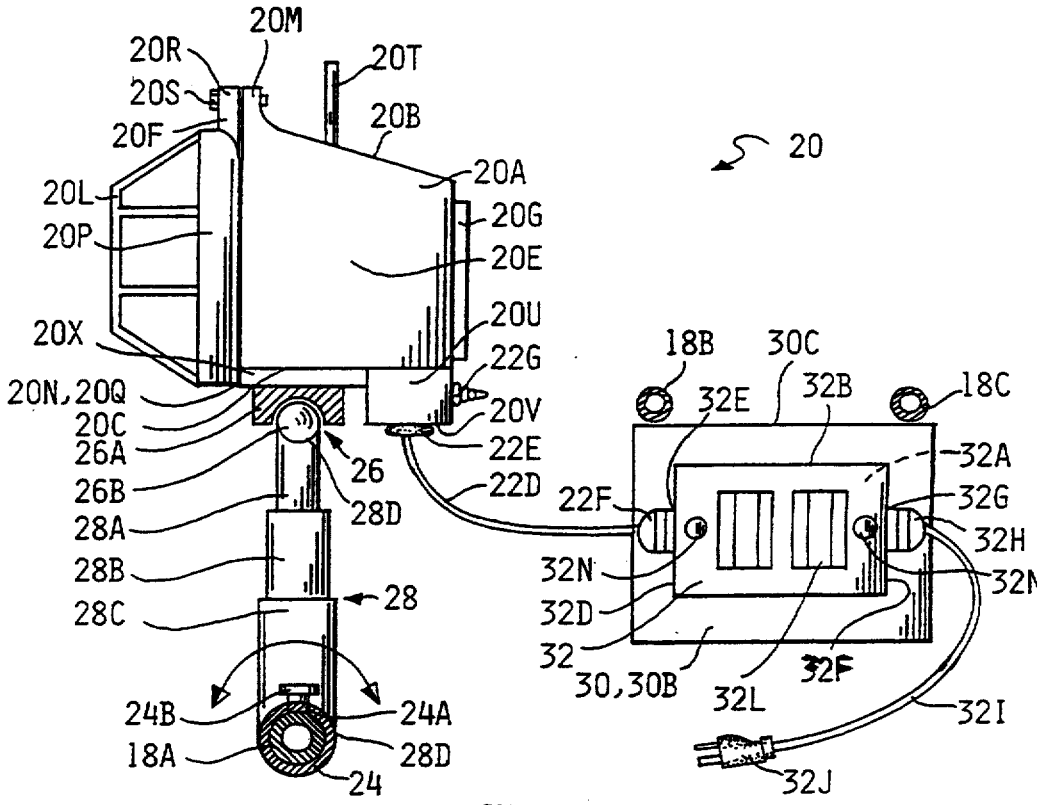

As shown in FIG. 11, the U-shaped wheel housing may also be designed with an inward housing 44M and an outward housing 44N. The inward housing 44M has an inward looped upper section 44P and the outward housing 44N has outward looped upper section 44Q. The outward looped upper section 44Q is sized to lockably interface with the inward looped upper section 44P. The two looped sections allow a wheel assembly 44 to be removed and attached with the wheel 44H attached.

The final two elements that comprise the apparatus 10 are the sitting and storage assembly 46 and a right and left light-assembly protective shield 48. The sitting and storage assembly 48 as shown in FIGS. 1, 2 and 8, consists of a basin-like container 48A and a resilient pad 46D.

The container 46A has a lower surface 46B that is attached by an attachment means 46C, to the upper longitudinal members 14A,16A of the left and right tubular sections 14,16. The attachment means preferably consists of a male detent located on each corner of the container's lower surface 46B. A corresponding female detent is attached, in alignment with the male detents, to the upper longitudinal members 14A,16A of the left and right tubular sections 14,16. When the container is pressed against the members 14A,16A, the container 46A is attached. Likewise, the container can be easily detached by lifting it upwards.

The resilient pad 46D is sized to fit over and be attached to one side of the container 46A and preferably the front side, by means of a hinge 46E as shown in FIG. 2. When the pad 46D is lifted to its open position, implements such as tools, may be stored and retrieved from the container 46A. Conversely, when the pad 46D is closed, the pad can be used as a seat. Additionally, if desired, a hasp and lock may be attached to secure the pad 46D to the container 46A.

The right and left light-assembly protective shields 48 are attached, by an attachment means, across the forward, side vertical sections of the respective left and right tubular sections 14,16. When the light assembly 20 is in its retracted, stowed position, the shields 48 protect the light assembly 20 from inadvertent side impacts.

While the invention has been described in complete detail and pictorially shown in the accompanying drawings, it is not to be limited to such details, since many changes and modifications may be made to the invention without departing from the spirit and the scope thereof. Hence, it is described to cover any and all modifications and forms which may come within the language and scope of the claims.

I claim:

1. A portable, light/power source and general utility apparatus, said apparatus comprising:

a) a protective structure, b) a light assembly that includes a lamp that is enclosed within a lamp housing having a lower side and having attached a lamp-power junction box that incorporates a switch/circuit breaker connected in series between a first side of a lockable power input connector and a first terminal of the lamp, where the lamp's second terminal is connected to a second side of the lockable power input connector, c) an articulated light assembly attachment mechanism comprising:

(1) a rotatable sleeve, rotatably attached to said protective structure, (2) a universal joint having a hemispherical upper section and a lower section, where the upper section is attached by an attachment means to the lower side of said lamp housing, (3) a multisectional-telescoping structure having an upper section attached, by an attachment means, to the lower section of said universal joint, and a lower section attached, by an attachment means, to the rotatable sleeve, where the combination of said rotatable sleeve, said universal joint and said telescoping structure allow said light assembly to be extended to a preferred height and placed in selectable omnidirectional positions or be retracted for stowage within said protective structure, d) an attachment plate attached within the protective structure and having an inward side and an outward side, where to the inward side of said plate is attached a reel axle and to the outward side of said plate is attached a utility-power junction box that has attached to one side, the lockable power-input connector from said light assembly and on the other side, extends a primary power input cord that terminates with a male power connector, e) a power-cord reel captively inserted into the reel axle, where said reel has an inward retainer to which is attached a female connector of an electrical power cord that is wound around said reel with the power cord terminating with a male connector that plugs into an a–c utility power outlet, where when the female connector of the electrical power cord is connected to the male power connector of the utility power junction box and the switch/circuit breaker is placed in the ON position, power is applied to the lamp on said light assembly, f) an enclosed compartment having a back side that is attached to the outward side of said attachment plate by an attachment means, g) a detachable wheel assembly attached to each lower corner of said protective structure by an attachment means, and h) a sitting and storage assembly comprising:

(1) a basin-like container having a lower surface that is attached, by an attachment means, to the upper surfaces of said protective structure, and (2) a resilient pad sized to fit over and to be attached to one side of the container by means of a hinge, where when the pad is lifted open, implements may be stored and retrieved from the container and conversely, when the pad is closed, the pad can be used as a seat.

2. The apparatus as specified in claim 1 wherein said protective structure employs tubular sections comprising:

(1) a left tubular section that includes an upper longitudinal member and a lower longitudinal member, (2) a right tubular section that includes an upper longitudinal member and a lower longitudinal member, and (3) a plurality of transverse members attached to the upper and lower longitudinal members of the left and right tubular sections, where the transverse members include a front, upper horizontal member.

3. The apparatus as specified in claim 1 wherein said lamp is a halogen lamp.

4. The apparatus as specified in claim 3 wherein the housing of said light assembly further comprises a protective lamp guard that is attached to the front side of the housing by an attachment means.

5. The apparatus as specified in claim 4 wherein the means for attaching the protective lamp guard to the housing, comprises:

a) said housing having on its upper side an upward extending threaded tab and an inward lip extending longitudinally across its lower side, and b) a frame captively retaining the protective lamp guard, where the bottom side of the frame has a U-shaped bottom end that is sized to be hooked to the inward lip on the housing, and the upper side of the frame has an upward tab having a bore therethrough into which is inserted a threaded bolt that when threaded into the threaded tab, the frame is detachably attached to the housing.

6. The apparatus as specified in claim 5 wherein the housing of said light assembly further comprises a handle that is attached to the upper side of the housing by an attachment means.

7. The apparatus as specified in claim 1 wherein the combination power switch/circuit breaker further comprises a water-proof jacket that encompasses a switch lever that projects through the front of the lamp-power junction box.

8. The apparatus as specified in claim 1 wherein the rotatable sleeve further having a threaded lock bore near its edge into which is threadably inserted a capped locking bolt that maintains the sleeve at a selectable rotatable position.

9. The apparatus as specified in claim 8 wherein the attachment means for said universal joint comprises:

a) said light assembly lamp housing having a lower side with at least two housing bores therethrough, b) a mounting plate having a lower surface to which is attached the hemispherical upper section of said universal joint, the mounting plate having at least two attachment bores therethrough that are in alignment with the corresponding set of housing bores, where into the two bores is inserted a threaded bolt that holds the mounting plate to the housing, and c) the lower member of said universal joint having a ball shade that is attached to the upper surface of an upper section of said multisectional telescoping structure, where the ball is sized to rotatably traverse within the hemispherical member.

10. The apparatus as specified in claim 1 wherein said utility power junction box further comprises:

a) an inward side that is rigidly attached, by an attachment means, to the outward side of said attachment plate, b) an outward side, c) a first side having a first bore that receives and has attached the lockable power input connector of the lamp power cord, d) a second side having a second bore that receives and has attached a lockable power input connector that has attached one end of a primary power input cord where said cord has on its other end a male power input connector, and e) an electric power-input circuit consisting of at least one auxiliary a–c power output circuit protected by a fuse, where the auxiliary circuit(s) terminate at an a–c power-output socket that extends from the outward side of said power junction box, where the auxiliary power-output socket(s) allow an external power implement such as a power tool to be electrically connected.

11. The apparatus as specified in claim 1 wherein said power cord reel further comprises a rotatable knob attached to the edge of the outward retainer, where the knob allows an individual to turn said power-cord reel to retract the electrical power cord onto said reel when the power cord is not being used.

12. The apparatus as specified in claim 11 wherein the front end of the reel axle is threaded to allow a threaded reel axle cap to be threaded therein, where when the cap is attached, said power cord reel remains captive, and when removed, said power cord reel may be removed from the apparatus.

13. The apparatus as specified in claim 1 wherein said detachable wheel assembly further comprises:

a) the lower longitudinal members of the left and right tubular section each having near their corners a horizontal wheel attachment bore, b) a U-shaped wheel housing having:

(1) a curved upper section sized to frictionally fit over the top of the lower longitudinal members and having downward sections that extend below the lower plane of the lower longitudinal section, (2) at least one housing attachment bore located central to the diameter of the lower longitudinal member, and (3) a wheel-axle bore located through both of the downward sections.

14. The apparatus as specified in claim 13 wherein said U-shaped wheel housing is further comprised of an inward housing and an outward housing, where the inward housing has an inward looped upper section and said outward housing has an outward looped upper section that is sized to lockably interface with the inward looped upper section, where the two looped sections allow a wheel assembly to be removed and attached with the wheel attached.

15. A portable light/power source and general utility apparatus, said apparatus comprising:

a) a protective tubular structure comprising:

(1) a left tubular section contiguously having an upper longitudinal member, a lower longitudinal member, a front member and a back member, (2) a right tubular section contiguously having an upper longitudinal member, a lower longitudinal member, a front member and a back member, (3) a front, upper transverse member, (4) a center, upper transverse member, (5) a rear, upper transverse member, where all the upper transverse members are attached by an attachment means to the upper longitudinal members of the right and left tubular sections, (6) a front, lower transverse member, (7) a back, lower transverse member, where both of the lower transverse members are attached to the lower longitudinal members of the right and left tubular sections, b) a light assembly comprising:

(1) a housing having an upper side, a lower side, a left side, a right side, a front side, a back side, and a lamp socket having a first side and a second side, where into the socket sides is inserted a lamp, (2) a protective lamp guard attached, by an attachment means, to the front side of the housing, where said guard protects the lamp inserted into the lamp socket, (3) a handle attached, by an attachment means, to the upper side of the housing, (4) a water-proof lamp-power junction box attached, by an attachment means to the lower side of the housing, where within said lamp-power junction box is located an electrical lamp-power circuit consisting of a combination switch/circuit breaker that is connected in series between a first side of a lamp power cord and to the first side of the lamp socket, where the second side of the lamp socket is connected to a second side of the lamp power cord, where both sides of the lamp power cord terminate at a water-proof grommet from where extends the lamp power cord that terminates at a lockable, power output connector, c) an articulated light assembly attachment assembly comprising:

(1) a rotatable sleeve inserted into the front, upper member, with the sleeve having an upper surface and near its edge, a threaded lock bore into which is threadably inserted a capped locking bolt that maintains the sleeve at a selectable rotatable position, where the selectable position includes an upward, working position and a downward stowed position where said light assembly is protectively located within the confines of said protective tubular structure, (2) a universal joint having an upper section a center section and a lower section, where the upper section is attached by an attachment means, to the lower side of the housing of said light assembly, (3) a multisectional, telescoping structure having an upper section, a center section and a lower section, where the upper section is rigidly attached, by an attachment means, to the lower section of the universal joint, and the lower section is rigidly attached by an attachment means, to the upper surface of the rotatable sleeve, where the combination of the rotatable sleeve, the universal joint and the telescoping structure allow said light assembly to be extended to a preferred height and placed in selectable omnidirectional positions or be retracted for stowage within said protective tubular housing, d) an attachment plate having an inward side, an outward side and an upward edge, where the upward edge is located inward from the inside edges of the right tubular section of said protective tubular structure and is attached to the lower surfaces of the center, upper transverse member, and the rear, upper transverse member of said protective tubular structure, e) a utility-power junction box comprising:

(1) an inward side that is rigidly attached, by an attachment means, to the outward side of said attachment plate, (2) an outward side, (3) a first side having a first bore that receives and has attached the lockable, power output connector of the lamp-power cord, (4) a second side having a second bore that receives and has attached a lockable power input connector that has attached one end of a primary power input cord where said cord has on its other end a male power input connector, (5) an electrical power-input circuit consisting of at least one auxiliary a–c power output circuit protected by a fuse, where the auxiliary circuit(s) terminate at an a–c power-output socket that extends from the outward side of said power junction box, where the auxiliary power-output socket(s) allow an external power implement such as a power tool to be electrically connected, f) a reel axle having a threaded front end and a back end, where the back end is rigidly attached, by an attachment means, to the inward side of said attachment plate and the front end extends outward within the confines of the left tubular section, g) an electrical power cord having on one end a female connector and on the other end a male connector sized to be plugged into an a–c utility power outlet, h) a power-cord reel consisting of a center core having therethrough a reel bore and on one end an inward retainer and on the other end an outward retainer, where said reel bore is sized to rotatably fit into said reel axle, where to the edge of the inward retainer is rigidly attached the female connector of said electrical power cord with the remainder of said electrical power cord wound around the center core of said power cord reel, with the outward side of the outward retainer further having a rotatable knob that allows an individual to turn said power-cord reel to retract said electrical power cord onto said reel when the power cord is not being used, and where, when said power cord is connected to the utility power outlet and the combination switch-/circuit breaker is set to the ON position, the lamp in said light assembly will illuminate, i) a threaded reel-axle cap that when threaded into the threaded front end of said reel axle, said power cord reel remains captive, and when removed, said power cord reel may be removed from the apparatus, j) a grated platform having reinforced edges and sized to fit over and be attached, by an attachment means, to the upper surface of the left and right lower longitudinal members and the front and back lower transverse members, k) an enclosed compartment comprising:

(1) a back side, a top side, a bottom side, two ends and a frontal opening, where the outer surface of the back side is attached, by an attachment means, to the lower, outward side of said attachment plate, below said utility-power junction box, and the bottom side is attached, by an attachment means to the upper surface of the lower longitudinal member of the right tubular section, (2) a front door having one of its longitudinal edges swivelly attached to one of the longitudinal edges of the frontal opening by a hinge, with the front door having a lock bore therethrough located near the edge opposite the hinge, where into the lock bore is inserted and attached a locking device that secures the door to said enclosed compartment, l) a detachable wheel assembly comprising:

(1) the lower longitudinal members of the left and right tubular sections each having near their corners a horizontal housing attachment bore, (2) a U-shaped wheel housing having:

(a) a curved upper section sized to frictionally fit over the top of the lower longitudinal members and having downward sections that extend below the lower plane of the lower longitudinal members, (b) at least one housing bore located central to the diameter of the lower longitudinal member, (c) a wheel-axle bore located through both of the downward sections, (3) at least one housing attachment bolt and nut combination that is inserted and attached through the housing bores and the housing attachment bore, (4) a wheel having an axle bore and that is rotatably housed between the inside surfaces of the U-shaped housing, (5) an axle inserted through the wheel axle bores and the axle bore with said axle bore having means for allowing the wheel to be maintained in place, m) a sitting and storage assembly comprising:

(1) a basin-like container having a lower surface that is attached, by an attachment means, to the upper longitudinal members of the left and right tubular sections, and (2) a resilient pad sized to fit over and be attached to one side of the container by means of a hinge, where when the pad is lifted open, implements may be stored and retrieved from the container and conversely, when the pad is closed, the pad can be used as a seat, and n) a left and right light-assembly protective shield, with each said shield attached, by an attachment means, across the forward, side vertical section of the respective left and right tubular sections, where when said light assembly is in its retracted, stowed position, said shields protect said light assembly from side impacts.

16. The apparatus as specified in claim 15 wherein said lamp is a halogen lamp.

17. The apparatus as specified in claim 16 wherein the means for attaching the protective lamp guard to the housing, comprises:

a) said housing having on its upper side an upward extending threaded tab and on its lower sides an inward lip, and b) a guard frame captively retaining the protective lamp guard, where the bottom side of the frame has a U-shaped bottom end that is sized to be hooked to the inward lip on the housing, and the upper side of the frame has an upward tab having a bore therethrough into which is inserted a threaded bolt that when threaded into the threaded tab, the frame is detachably held against to the housing.

18. The apparatus as specified in claim 15 wherein the combination power switch/circuit breaker further comprises a water-proof jacket that is placed over its a switch lever that projects through the front of the lamp-power junction box.

19. The apparatus as specified in claim 15 wherein the attachment means for said universal joint comprises:

a) a light assembly with a housing having a lower side with at least two housing bores therethrough, b) a mounting plate having a lower surface to which is attached the hemispherical member of said universal joint, the plate having at least two attachment bores therethrough that are in alignment with the corresponding set of housing bores, where into the two bores is inserted a threaded bolt that holds the mounting plate to the housing, and c) the ball member of said universal joint attached to the upper surface of an upper section of said multi-sectional telescoping structure, where the ball is sized to rotatably traverse within the hemispherical member.

20. The apparatus as specified in claim 15 wherein said U-shaped wheel housing is further comprised of an inward housing and an outward housing, where the inward housing has an inward looped upper section and said outward housing has outward looped upper section that is sized to lockably interface with the inward looped upper section, where the two looped sections allow a wheel assembly to be removed and attached with the wheel attached.

21. The apparatus as specified in claim 15 wherein said sitting and storage assembly attachment means comprises:

a) a male detent located on each corner of the bottom surface of the basin-like container, and b) a corresponding female detent attached in alignment to the upper surface of the upper longitudinal members of the left and right tubular sections.

* * * * *

UNITED STATES PATENT AND TRADEMARK OFFICE

CERTIFICATE OF CORRECTION

PATENT NO. : 5,418,701

DATED : May 23, 1995

INVENTOR(S) : Don B. Hart

It is certified that error appears in the above-indentified patent and that said Letters Patent is hereby corrected as shown below:

Delete Drawing Sheet 3 of 5, and substitute therefor the Drawing Sheets, consisting of Figs. 4 and 5, as shown on the attached pages.

Signed and Sealed this

Tenth Day of September, 1996

*Attest:*

*Attesting Officer*

BRUCE LEHMAN

*Commissioner of Patents and Trademarks*